US006354400B1

(12) United States Patent
Purkayastha

(10) Patent No.: US 6,354,400 B1
(45) Date of Patent: Mar. 12, 2002

(54) CYLINDRICAL SURFACE GRIPPING DEVICE FOR USE WITH A LADDER

(75) Inventor: Abhijeet Purkayastha, Houston, TX (US)

(73) Assignee: Abhijeet International, Inc., Houston, TX (US)

( * ) Notice: Subject to any disclaimer, the term of this patent is extended or adjusted under 35 U.S.C. 154(b) by 0 days.

(21) Appl. No.: 09/418,123

(22) Filed: Oct. 14, 1999

(51) Int. Cl.[7] ..... E06C 7/42
(52) U.S. Cl. ..... 182/107; 182/108
(58) Field of Search ..... 182/107, 214, 182/120, 121, 108; 248/345.1; 135/73

(56) References Cited

U.S. PATENT DOCUMENTS

| | | | | |
|---|---|---|---|---|
| 1,994,369 A | | 3/1935 | Risser | 288/61 |
| 2,383,354 A | * | 8/1945 | Teeter | 248/345.1 |
| 2,925,877 A | * | 2/1960 | Wright | |
| 3,407,900 A | | 10/1968 | Hopfeld | 182/107 |
| 3,669,490 A | * | 6/1972 | Berto et al. | 248/345.1 |
| 3,828,889 A | | 8/1974 | Rehm | 182/107 |
| 4,106,739 A | * | 8/1978 | Gasser | 248/345.1 |
| 4,109,887 A | * | 8/1978 | Wakeland | 248/345.1 |
| 4,469,194 A | * | 9/1984 | McBride | |
| 4,899,848 A | * | 2/1990 | Parr | 182/214 |
| 5,012,895 A | | 5/1991 | Santos | 182/204 |
| 5,222,575 A | | 6/1993 | Santos | 182/108 |
| 5,373,913 A | | 12/1994 | Santos | 182/107 |
| 5,692,581 A | | 12/1997 | Nelson et al. | 182/129 |
| 6,021,865 A | * | 2/2000 | Thompson | 182/107 |

FOREIGN PATENT DOCUMENTS

| | | | | |
|---|---|---|---|---|
| GB | 2185775 | * | 7/1987 | 182/120 |

* cited by examiner

*Primary Examiner*—Alvin Chin-Shue
(74) *Attorney, Agent, or Firm*—Ronald M. Anderson

(57) ABSTRACT

A gripping device intended to improve the grip of a ladder on the rounded surface of a pole, tree, or other cylindrical object, as well as objects that are substantially planar. The invention is designed to attach to the top rung of an extension or straight ladder to prevent the ladder from slipping from or rotating about such a surface. The device gripping is preferably molded from polyethylene or other elastomeric material and it is intended to grip a rung of the ladder (at or adjacent the top rung) when interposed between the rung and the surface against which the ladder is positioned while in use. To minimize the weight of the gripping device, a plurality of elliptical cavities are formed in the device adjacent to each end, and two holes extend longitudinally through the device adjacent its back gripping surface. In a preferred embodiment, the back gripping surface of the device is concave and includes a plurality of laterally extending rib sections and a plurality of sections in which spaced-apart spikes or bristles are formed. These texture elements on the surface increase the coefficient of friction against the surface supporting the ladder. A further feature is that gripping tangs disposed at each end of the device include longitudinally extending ribs, as well as transversely extending ribs formed in the back portion of the gripping sections of the device, i.e., on the interior surface of the slot-like opening that grips the rung.

28 Claims, 8 Drawing Sheets

CYLINDRICAL SURFACE GRIPPING DEVICE FOR USE WITH A LADDER

FIELD OF THE INVENTION

This invention generally relates to accessories for ladders that improve the traction between the upper portion of the ladder and a supporting surface, and more specifically, to an attachment for a ladder that enables the ladder to be more securely positioned against either a round or a flat surface.

BACKGROUND OF THE INVENTION

Death and serious injury frequently are the result of accidents involving ladders, both in the home and in the workplace. Numerous regulations and safety practices have been promulgated by government agencies, such as the Occupational Safety and Health Administration (OSHA) and the National Institute of Occupational Safety and Health (NIOSH), to prevent such injuries. Ladders are commonly available in two categories, including those that are self-supporting and those that are not. Self supporting ladders, which include certain specialty ladders, three-point ladders, and step-ladders, are typically available in shorter lengths, are generally more expensive, and tend to be heavier. Non-self-supporting ladders, such as one-piece straight ladders, and extension ladders, are quite common and used extensively.

For convenience, the term "ladder" as used hereafter in this discussion, and in the specification and claims that follow, shall refer only to non-self-supporting ladders, as opposed to self-supporting ladders.

Ladders are generally leaned against a tree, a pole, a building, a wall, or other structure when in use. Care must be taken to ensure that both the base and the top of the ladder are secured to prevent slippage. A variety of safety accessories are readily available to help secure the base of the ladder, preventing it from shifting. Hooks and other attachments are also available that improve the grip of the top of the ladder on a surface to prevent the top of the ladder from shifting laterally. Preventing the top of the ladder from shifting has proved particularly difficult when the structure that the ladder is being leaned against is round or irregular in shape. When the top of the ladder engages a planar surface, a reasonably secure contact can normally be obtained. However, when the surface is round, like a pole or a tree, it is difficult to prevent the ladder from rotating around the point of contact of the top rung against the round surface, since the stiles of the ladder are usually not positively supported. With the upper rung of the ladder rather than the stiles of the ladder resting against the supporting surface, the ladder will generally feel precarious and be prone to shifting.

The prior art has developed devices to enable a more positive engagement between the upper portion of a ladder and a non-planar or generally cylindrical surface. U.S. Pat. No. 4,469,194 (McBride) discloses a sponge-like block having a semicircular metal member that engages the top rung of a ladder, so that the sponge-like block stabilizes the ladder when the ladder is rested against a wall, tree, or pole. The semicircular metal member is secured to the sponge rubber block using adhesive or rivets. The ends of the semicircular member, which extend beyond each end of the block, are attached to the top rung of the ladder using clamps (such as common hose clamps). Thus, the '194 patent teaches a device that incorporates three distinct elements: the clamping members, the semicircular member, and the resilient sponge-like block member. While such a device can add more stability when a ladder is used in conjunction with a planar or generally cylindrical surface due to the increased friction between the sponge-like block and the surface, the clamping means preclude the device from being conveniently removed when not required, because a tool is required to release the hose clamps. Often in a work environment, or even at home, several ladders of different sizes are available. It would be desirable to provide a gripping device that can be quickly removed from one ladder and attached to a different ladder so that a single such device could be used with a number of different ladders.

U.S. Pat. No. 1,994,369 describes a generally V-shaped bar that is permanently affixed to the stiles of a ladder near the upper rungs to provide an improve support when the ladder is rested against a pole or other generally cylindrical/round surface. U.S. Pat. No. 3,407,900 describes a flexible strap that is permanently affixed in the same location. Again, while both devices provide more positive engagement and enhanced friction between the upper end of a ladder and a generally cylindrical surface, such devices cannot be readily removed from one ladder to be used with a different ladder, and if attached to the stiles of the ladder, can be cumbersome.

U.S. Pat. Nos. 2,925,877 and 3,828,889 describe devices incorporating a flexible strap that is affixed to an end cap at each end of the strap. The end caps are sized to fit over the tops of the ladder stiles. While such devices can be readily removed from one ladder and placed onto another ladder, due to its design, the strap must be positioned over the end caps of the stiles. Thus, the strap can only be located at the extreme upper end of the ladder. There will be instances in which the optimum location for an accessory that provides improved support when a ladder must be leaned against a generally cylindrical surface will not be at the extreme upper portion of the ladder, but in a position that is somewhat lower.

In 1991, an internal safety committee from an employer requested that OSHA indicate how a ladder should be safely used when rested against a column. OSHA responded by noting that OSHA requires the base of the ladder to be secured if used on a slippery concrete surface (29 CFR 1926.1053(b)(7)), and that stiles at the top of the ladder must be supported equally (29 CFR 1926.1053(b)(10)). As an added precaution, OSHA suggested that body belt/harness systems should be rigged to lifelines attached to the columns, or that means be provided to secure the top of the ladder in place by the use of a wide fork-like attachment at the top of the ladder that would overlap the sides of the column to prevent the ladder from sliding off the column. Notably, OSHA did not suggest the use of any of the prior art devices discussed above, possibly indicating that these prior art devices have not been widely accepted in the marketplace and are not believed by OSHA to provide adequate assurances of safety.

Therefore it would be desirable to develop a device that can enhance the safety of ladders when used with either a planar or a generally cylindrical surface. To become adopted in the marketplace, such a device should be simple to use, easy to remove from one ladder for use on a different ladder, of low cost, and should be readily positionable at any of a plurality of rungs near the upper portion of a ladder to allow greater flexibility in safely positioning the ladder so that it does not slip on a supporting surface, whether the surface is flat or rounded.

SUMMARY OF THE INVENTION

In accord with the present invention, a gripping device attachable to a ladder rung for the purpose of stabilizing a ladder is defined. The gripping device includes a generally elongate elastomeric member having at least one slot formed in a front portion thereof. The slot is of a size and shape generally corresponding to that of a rung of a ladder with which the gripping device will be used. The elastomeric properties of the generally elongate elastomeric member cause it to grip a ladder rung with a force sufficient to secure the generally elongate elastomeric member to the rung.

A back surface of the generally elongate member is adapted to provide an enhanced coefficient of friction to increase a frictional force between a structure and an upper portion of the ladder, such that the frictional force stabilizes the ladder. The increased frictional force ensures that it will be less likely the upper portion of the ladder will move relative to the structure supporting the upper portion of the ladder. In one embodiment, the back surface of the elastomeric member includes a plurality of texture elements that further increase the coefficient of friction between the back surface and any surface against which the gripping device and ladder are rested. These texture elements preferably include at least one of a spaced-apart array of spikes, a spaced-apart array of bristles, and outwardly extending ribs. Also preferably, the back surface is concave, such that the gripping device can more readily conform around a generally cylindrical surface.

Preferably, the generally elongate elastomeric member is fabricated as an integral unit from a plastic material. In one embodiment, an internal surface of the slot includes a plurality of texture elements that increase a coefficient of friction between the generally elongate elastomeric member and a ladder rung. These texture elements include at least one of outwardly extending ribs, and bristles.

In another embodiment, a first slot formed in the elongate member grips a rung adjacent to a first stile of the ladder, and a second slot grips the rung adjacent to a second stile of the ladder. The mass of the generally elongate elastomeric member is reduced by including a void space within its interior. One embodiment includes a plurality of voids disposed on the top and bottom surfaces of the generally elongate elastomeric member. In another embodiment, the void space comprises one or more cavities that extend longitudinally through the generally elongate elastomeric member.

Because the cross-sectional shape and area of ladder rungs can vary from one ladder style to the next, the size and shape of the slot in the elongate member is adapted to fit different types of rungs. A cross-sectional shape of the slot includes at least one of a triangle, a circle, a "D" shape, and a square.

In one form of the invention, at each end, either the upper or the lower gripping tang of the slot is fabricated as a flexible strap having a plurality of orifices formed in it, and the other of the upper or the lower gripping tang is fabricated as a flexible strap having a knob of a size and shape generally to provide an interference fit through any of the plurality of orifices. The knob on the flexible strap at each end of the elongate member is oriented such that when a ladder rung is inserted into the slot, the flexible strap with the knob engages the flexible strap with the plurality of holes, at both ends, to secure the ladder rung within the slot.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

Description of the Preferred Embodiment

Figure 1:
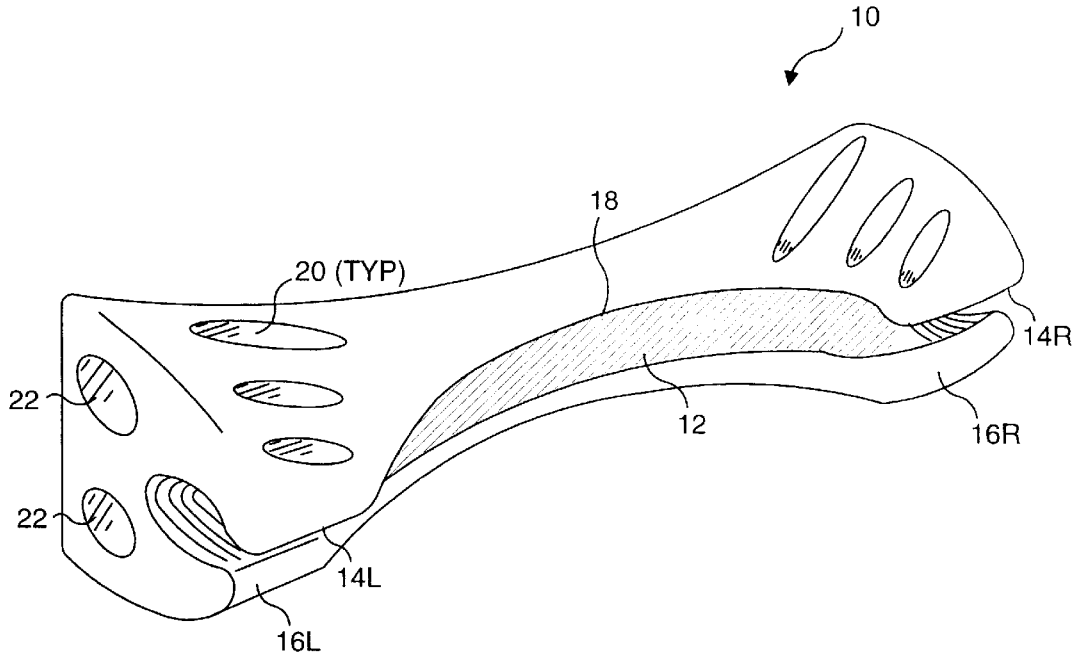
FIG. 1 is a schematic view of a first embodiment of a gripping device in accord with the present invention.

FIG. 1 illustrates a first preferred embodiment of a gripping device 10 for use with a ladder and which is designed to attach to one of the upper rungs of a ladder. As the upper portion of the ladder is positioned against a surface that will be employed to support the ladder, the gripping device contacts that surface and increases a coefficient of friction between the gripping device and that surface, thus greatly increasing the stability and safety of the ladder.

Preferably, gripping device 10 is of an integral, unitary construction and is fabricated from an appropriate elastomeric material such as polyethylene plastic using conventional injection molding techniques. However, other types of durable elastomeric materials can be used, such as a natural rubber or a synthetic rubber material. Gripping device 10 is generally elongate in shape and incorporates a cavity or slot 12, which extends longitudinally along the center of gripping device 10. Slot 12 generally corresponds in size and shape to that of a rung of the ladder with which gripping device 10 is to be used. Gripping device 10 also incorporates upper tangs 14 and lower tangs 16, which extend partially around the ladder rung at both the right and left ends of slot 12, and cooperate to securely attach gripping device 10 to the ladder rung. Because gripping device 10 (and thus also, tangs 14 and 16) is fabricated from the elastomeric material, gripping tangs 14 and 16 deflect as the ladder rung is inserted into slot 12, and once the ladder rung is seated within slot 12, the gripping tangs exert an elastomeric force that biases them toward their rest positions (i.e., their positions before they were deflected to insert the ladder rung into slot 12). Accordingly, they provide a substantial force around the ladder rung that snugly secures gripping device 10 to the ladder rung.

Gripping device 10 includes a number of features that reduce the amount of material required to fabricate gripping device 10, and thus, reduce its weight. Gripping device 10 is formed with an arc 18 that curves inwardly toward the center of slot 12, which not only reduces the mass of material, but also makes it easier for the gripping device to be attached to a ladder rung. A plurality of voids 22 extend longitudinally through gripping device 10 and reduce the amount of material required. Gripping device 10 has also been fabricated with a plurality of elliptical depressions 20 on the upper and lower surfaces of gripping tangs 14 and 16 to reduce the material used and to improve the appearance of the gripping device. It should be readily understood by those of ordinary skill in the art that the actual size and shapes of elliptical depressions 20, voids 22, and arc 18 can be varied to selectively control the amount of material that is eliminated. However, eliminating too much material will reduce the strength of the gripping device, and those of ordinary skill in the art will readily understand that there is a tradeoff between material elimination/weight reduction and providing sufficient structural integrity for gripping device 10.

Figure 2:
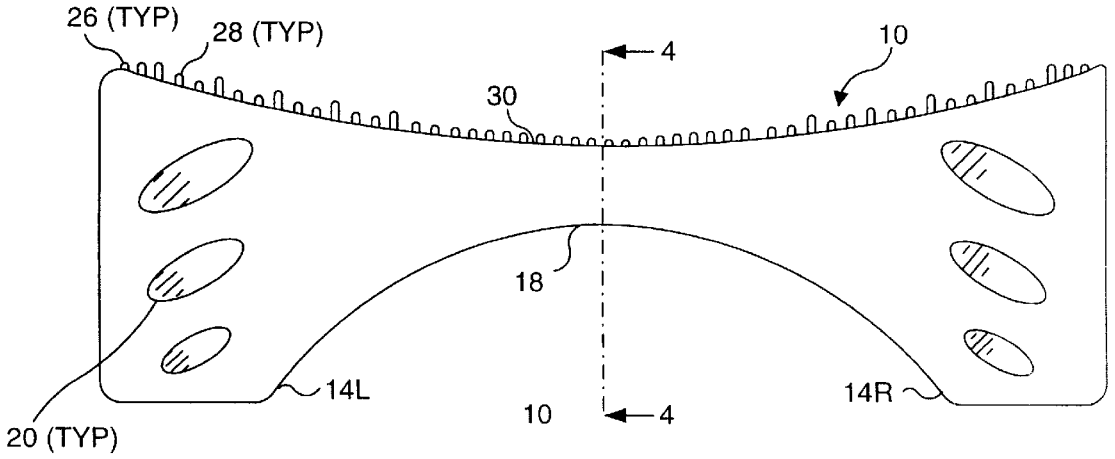
FIG. 2 is a top plan view of the first embodiment illustrated in FIG. 1.

FIG. 2 shows a top plan view of gripping device 10. Elliptical depressions 20 are clearly visible. As illustrated in FIG. 2, elliptical depressions 20 have been configured in an esthetically decorative pattern; however, it will be understood by those of ordinary skill in the art that no particular pattern is necessary, as the functional aspect of elliptical depressions 20 is simply to remove material that is not required for the structural integrity of gripping device 10 and thus, to reduce the weight and material required to produce gripping device 10.

Figure 5:
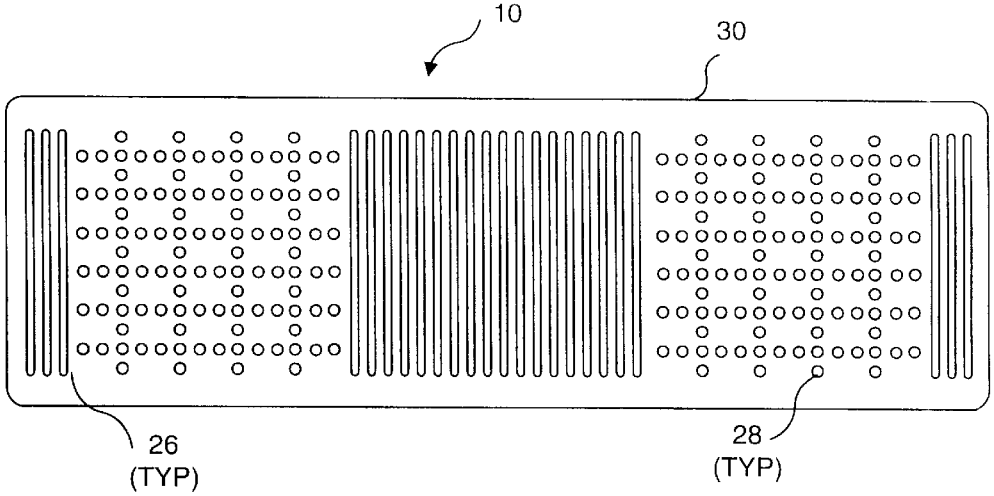
FIG. 5 is a rear elevational view of the first embodiment.

A plurality of ribs 26 and bristles 28 are molded into a rear surface 30 of gripping device 10. The purpose of ribs 26 and bristles 28 is to increase the coefficient of friction between the rear surface of gripping device 10 and the surface of any structure against which the ladder (i.e., the rung of the ladder on which gripping device 10 is installed) is being leaned. As gripping device 10 is attached to the rung of a ladder, the rear surface of gripping device 10 will be in contact with the structure. Ribs 26 extend transversely relative to the longitudinal axis of the gripping device to prevent slippage of the ladder when it is in position. A preferred pattern of ribs 26 and bristles 28 is illustrated in FIG. 5, although it should be recognized that many other patterns or textures would be suitable for enhancing and increasing friction between the gripping device and the supporting surface of a structure against which a ladder is leaned. Also visible in FIG. 2 are upper tangs 14L and 14R.

It should further be noted that as shown in FIG. 2, rear surface 30 of gripping device 10 is concave in shape. This particular shape is expected to be especially useful when gripping device 10 is used on a ladder which is positioned to lean against a pole, a tree, or other generally cylindrical surface. In such a use, the concave shape of surface 30 is particularly useful in preventing the ladder from shifting or rolling around what normally would be very unstable surface. It is anticipated that other embodiments of a gripping device in accord with the present invention might beneficially have a generally planar rear surface, instead of the concave shape of surface 30. Such an alternative embodiment would be well suited for supporting a ladder leaned against structure such as walls and buildings that have generally planar surfaces. Regardless of whether the rear surface of the gripping device is concave or planar, it is important that the gripping device be sufficiently thick (as measured between the front surface of the gripping tangs and the rear surface) so that the rear surface contacts the cylindrical or planar surface against which the ladder is leaned. In other words, the thickness of the gripping device must be such that the rear surface of the gripping device extends beyond the stiles of the ladder, and if the surface extends above the rung on which the gripping device is attached to the ladder, the thickness must be sufficient to extend beyond the upper portion of the stiles that project beyond the rung on which the gripping device is attached. It is important that the gripping device support the ladder against the surface, rather than the ladder being supported by the top portion of the stiles, or there will be no advantage in using the gripping device.

Figure 3:
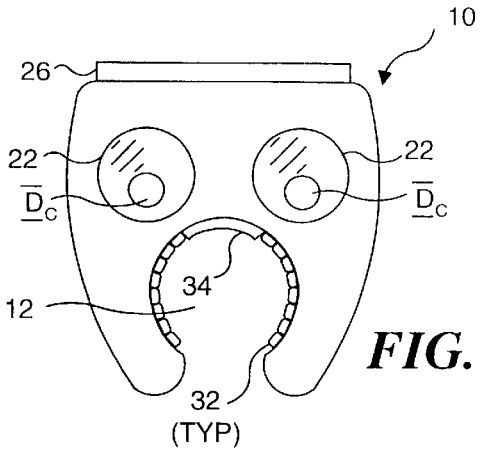
FIG. 3 is a side elevational view of the first embodiment illustrated in FIG. 1.

FIG. 3 illustrates a side elevational view of gripping device 10. Two voids 22 can be clearly seen. In a preferred embodiment, voids 22 are not simply cylindrical in shape with a constant cross section along the lengths of the voids as they extend longitudinally through gripping device 10. Instead, voids 22 have a relatively larger circular cross-sectional diameter on both the right and left sides of gripping device 10, and as the voids extend longitudinally through gripping device 10, they converge to smaller circular cross-sectional diameters $D_C$ at a center 36 of gripping device 10. This shape for the voids ensures that enough material is present near the center of gripping device 10 to provide the required structural integrity. It should be noted that at the center of gripping device 10, the concave shape of rear surface 30 and arc 18 have significantly reduced the amount of material present.

Figure 6:
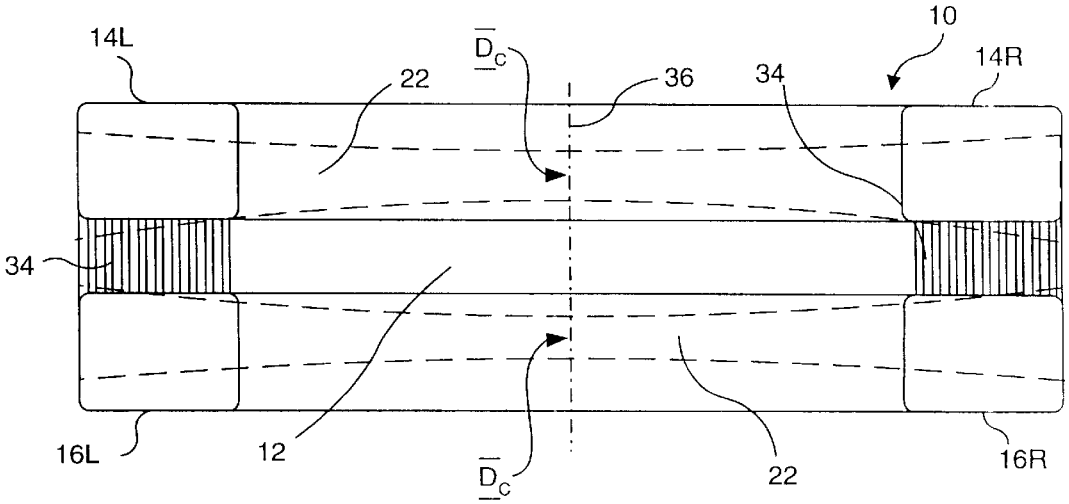
FIG. 6 is a front elevational view of the first embodiment.

Slot 12 can also be clearly seen in FIG. 3. Within slot 12 are a plurality of latitudinally extending ribs 34, and a plurality of longitudinally extending ribs 32. It should be noted that in this embodiment, ribs 32 and 34 are present only in the portion of slot 12 adjacent to upper tangs 14 and lower tangs 16. However if desired, ribs 34 can extend across the entire longitudinal length of the gripping device 10. As can be seen in FIG. 6, in the preferred embodiment of gripping device 10, ribs 34 are disposed only within the portion of slot 12 that corresponds to the upper tangs 14 and lower tangs 16. The function of ribs 32 is to prevent longitudinal movement of the gripping device along a ladder rung, and the function of ribs 34 is to prevent rotation of the gripping device about the ladder rung on which it is attached.

Figure 4:
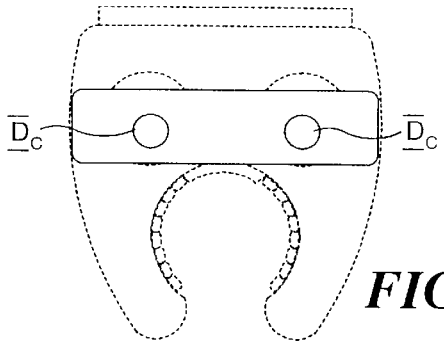
FIG. 4 is a cross-sectional view of the first embodiment, taken along section line 4—4 of FIG. 2 and including the side elevational view of FIG. 3 shown in phantom (for purposes of reference)

FIG. 4 is a cross-sectional view of gripping device 10 taken along Line 4A of FIG. 2. Also shown in FIG. 4 is a side elevational phantom view of gripping device 10, clearly illustrating why voids 22 preferably converge to smaller circular cross-sectional diameter $D_c$ at center 36 of gripping device 10.

FIG. 6 is a front elevational view of gripping device 10. Voids 22 are indicated with dash lines, and the reduction in the cross-sectional diameter of voids 22 to achieve the smaller circular cross-sectional diameter $D_c$ at center 36 of gripping device 10 is clearly evident. Also seen in FIG. 6 are upper tangs 14L/14R and lower tangs 16L/16R. Ribs 34 can be seen within slots 12, adjacent to the gripping tangs.

Figure 7:
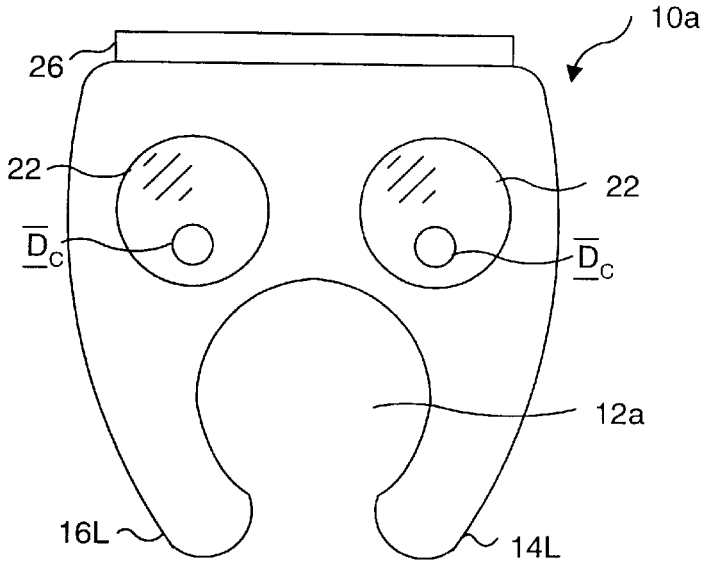
FIG. 7 is a side elevational view of a second embodiment of a gripping device in accord with the present invention.
Figure 7A:
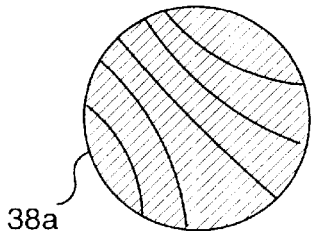
FIG. 7A is a cross-sectional view of a wooden ladder rung having a circular cross section, which the second embodiment is adapted to grip.

While ladder rungs are most commonly circular in cross section, other shapes are also used for ladder rungs. Thus, it is contemplated that the gripping device will also be provided with slots of different shapes selected to closely match the other shapes and sizes of ladder rungs commonly in use. FIG. 7 illustrates a gripping device 10*a* a with a slot 12*a* having a circular cross-sectional shape. Gripping device 10*a* a does not have any ribs 32 or 34 disposed in slot 12*a*. If the cross-sectional size and shape of slot 12*a* is closely matched with the cross-sectional size and shape of a particular rung for a particular style ladder, then the elastomeric properties of the material from which gripping device 10*a* a is fabricated should enable gripping device 10*a* a to be attached and securely held in position by upper and lower tangs 14 and 16. However, the inclusion of ribs 34 and bristles 32 within the slot (as illustrated in FIG. 3 for gripping device 10) would be useful to both increase the friction between the griping device and the ladder rung, as well as to allow the gripping device to be used with ladder rungs whose cross-sectional size and shape are not as closely matched to the size and shape of the slot. It should be noted that in all cases, when the gripping device is attached to a ladder rung, the upper and lower tangs deflect away from the ladder rung as the gripping device is forced over the ladder rung. As the ladder rung becomes seated within the slot that extends longitudinally through the gripping device, the upper and lower gripping tangs are biased to return to their original position such that the tangs almost completely encircle the ladder rung except for a small opening at the front of the slot in the gripping device. FIG. 7A illustrates a typical round wooden ladder rung 38*a* having a cross-sectional diameter closely matching that of slot 12*a*.

Figure 8:
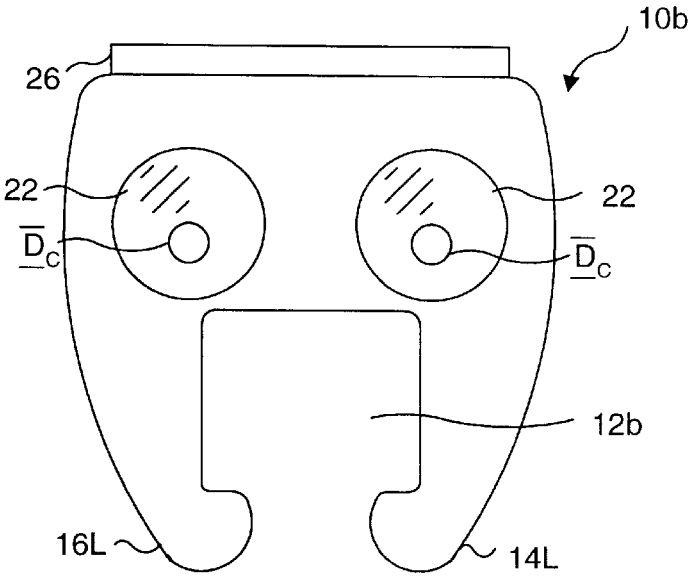
FIG. 8 is a side elevational view of a third embodiment of a gripping device in accord with the present invention.
Figure 8A:
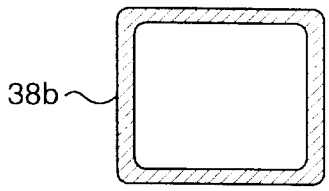
FIG. 8A is a cross-sectional view of a tubular metal ladder rung having a generally square cross section, which the third embodiment is adapted to grip.
Figure 9:
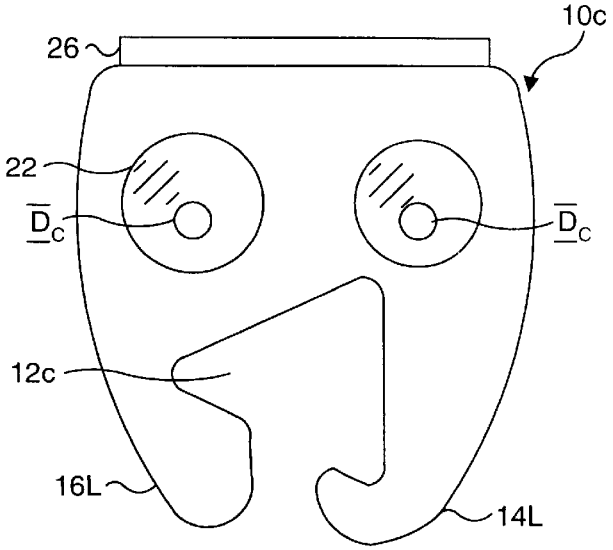
FIG. 9 is a side elevational view of a fourth embodiment of a gripping device in accord with the present invention.
Figure 9A:
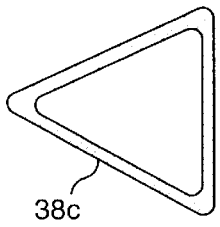
FIG. 9A is a cross-sectional view of a tubular metal ladder rung having a triangular cross section.
Figure 15:
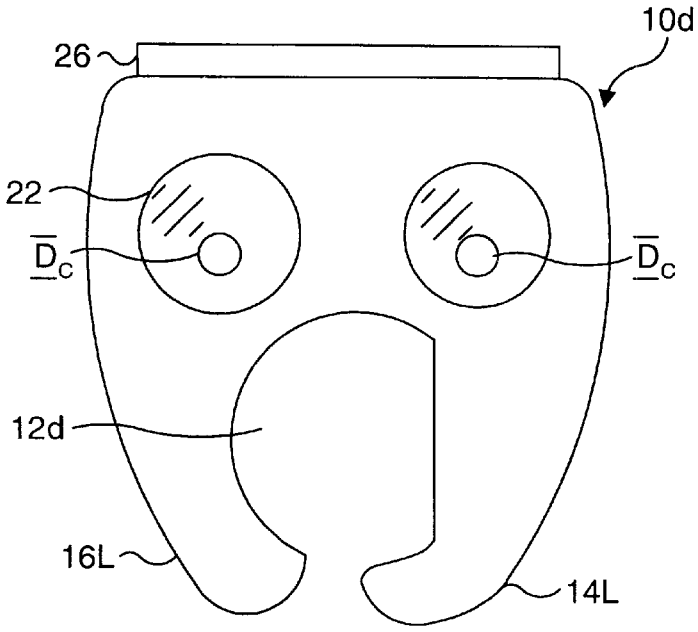
FIG. 15 is side elevational view of a fifth embodiment of a gripping device in accord with the present invention.
Figure 15A:
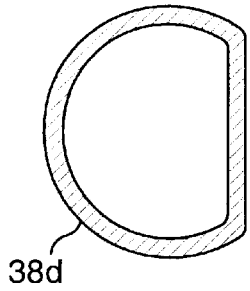
FIG. 15A is a cross-sectional view of a tubular metal ladder rung having a "D-shaped" cross section.

FIG. 8 illustrates a gripping device 10*b*, which has been adapted to be used in conjunction with ladder rungs that have substantially rectangular cross-sectional areas. FIG. 8A illustrates a typical metal ladder rung 38*b* (note such rungs are normally formed as extruded tubes) having a size and shape generally corresponding to slot 12*b*. FIG. 9 illustrates a gripping device 10*c* that has a slot 12*c*, which has been adapted to be used in conjunction with ladder rungs having a triangular cross-sectional area. FIG. 9A illustrates a typical metal ladder rung 38*c* having a size and shape generally corresponding to slot 12*c*. Again, no ribs 32 or 34 have been illustrated, although such ribs can be included within the slots of any of the embodiments of the gripping device, if desired. In FIG. 15, a gripping device 10*d* is illustrated, which has a slot 12*d* that is adapted to grasp a ladder rung 38*d* having a "D-shaped" cross section, as shown in FIG. 15A.

Figure 10:
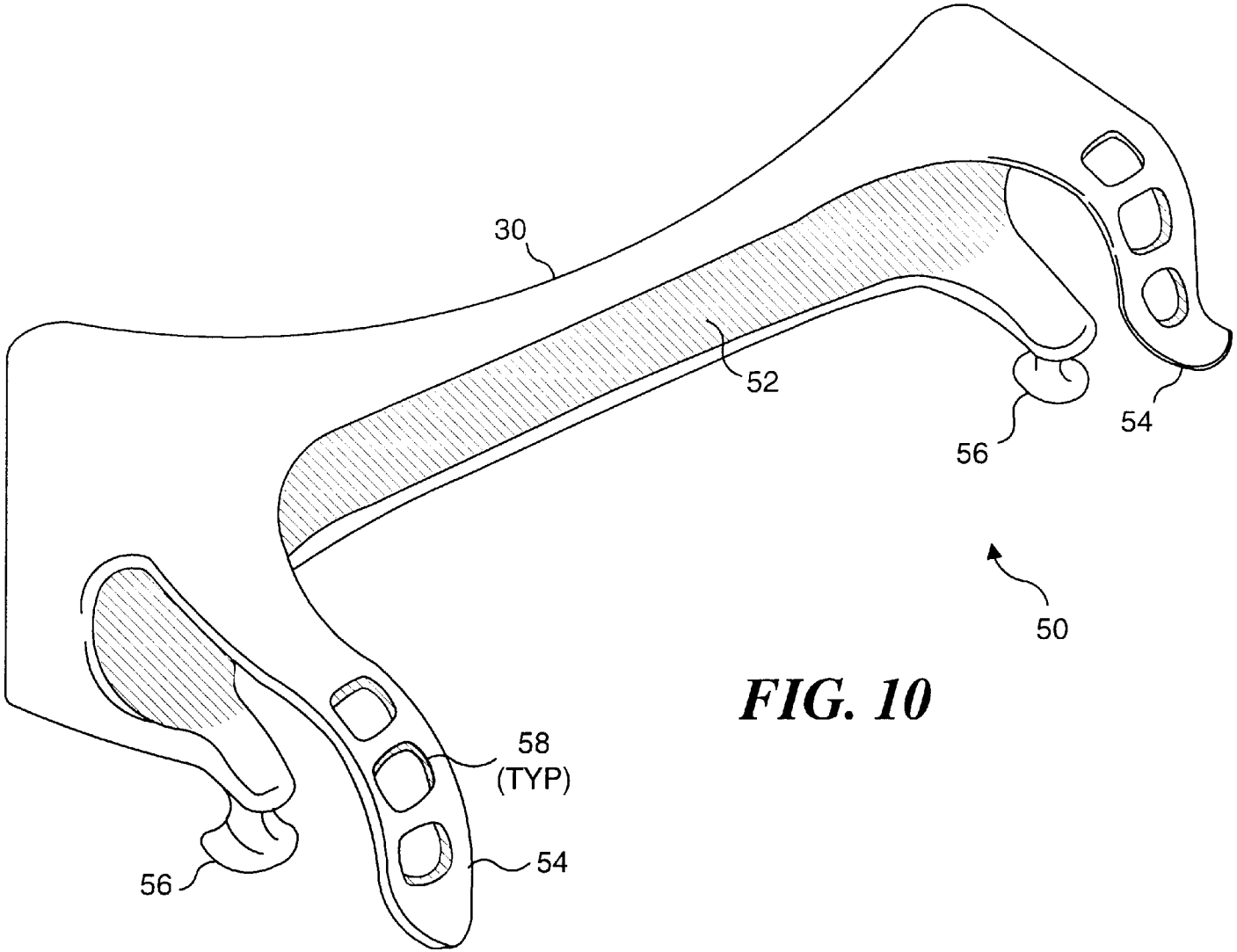
FIG. 10 is a schematic view of a fifth embodiment of a gripping device in accord with the present invention.

FIG. 10 illustrates a gripping device 50, which is an alternative preferred embodiment. In gripping device 50, the upper tangs and the lower tangs have been modified relative to the previous disclosed embodiments. The ends of the upper tangs on gripping device 50 are each formed as a narrow strap member 54, which incorporates a plurality of holes 58. The lower tangs have been modified to include a knob 56 of a size and shape appropriate to enable it to provide an interference fit when inserted through holes 58 in upper straps 54. Gripping device 10 includes a slot 52, which runs longitudinally down the center of gripping device 50. As was the case with the embodiments discussed above, gripping device 50 incorporates the concave shape of rear surface 30. Preferably, rear surface 30 includes ribs 26 and bristles 28 as illustrated in FIGURES. As discussed earlier, a concave shape of the rear surface is particularly well suited to provide stability to a ladder when the ladder is being supported by leaning against a curved surface, such as a pole, a tree, or other generally cylindrical object. It should be understood however, that a gripping device with a generally planar rear surface could be beneficially employed to increase the stability of a ladder being used in conjunction with a generally planar surface and that any of the embodiments that include the concave shape of rear surface 30 also provide an enhanced coefficient of friction if used on a ladder leaned against a generally planar surface.

Figure 11:
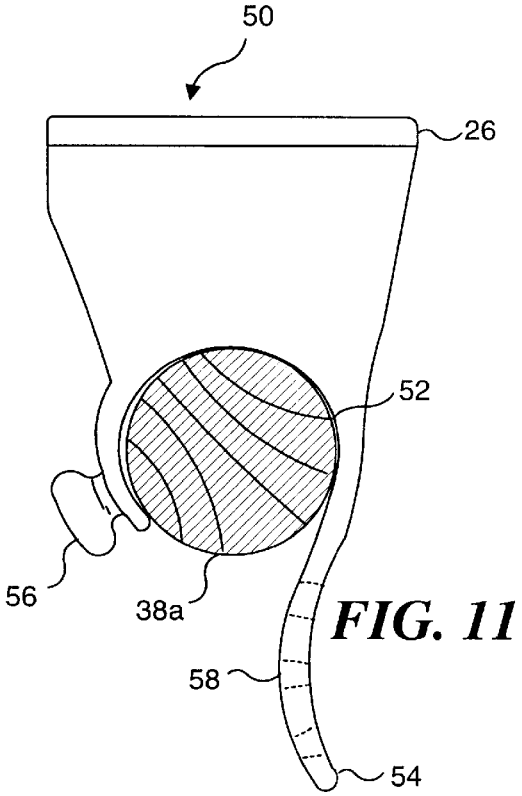
FIG. 11 is a side elevational view of the fifth embodiment illustrated in FIG. 10 showing the gripping device being placed in position on a ladder rung.
Figure 12:
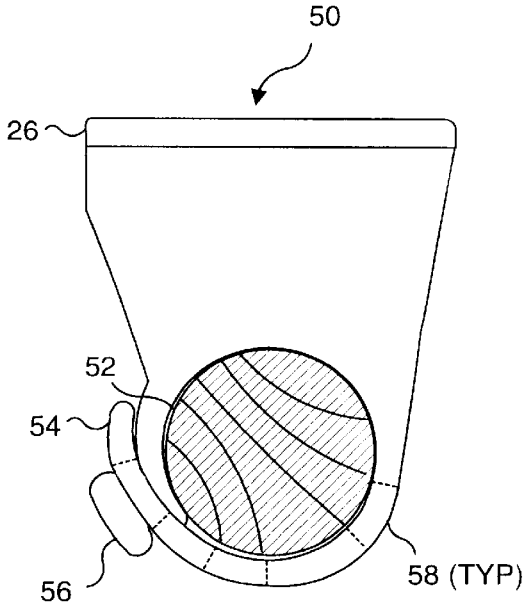
FIG. 12 is a side elevational view of the fifth embodiment illustrated in FIGS. 10 and 11 showing the gripping device being secured in position on a ladder rung.

FIG. 11 illustrates a side view of gripping device 50. A wooden ladder rung 38*a* has been inserted into slot 52. In FIG. 12, straps 54 are snubbed around the exterior of ladder rung 38 and knobs 56 have been inserted through holes 58, thus securely attaching gripping device 50 to the ladder rung. This embodiment does not rely solely on the elastomeric bias of the material to retain it on the ladder rung, but instead more securely fastens the gripping device to the ladder rung using straps 54 and knobs 56.

Gripping device 50 does not include any material reducing voids such as elliptical depressions 20 or voids 22. However, such features could be incorporated in this embodiment, if desired. Because gripping device 50 does not require upper and lower tangs to perform the gripping action in the manner of the tangs in gripping device 10, the upper and lower tangs of gripping device 50 can be fabricated with less material. Thus, even without voids 22 or elliptical depressions 20, gripping device 50 has less mass and weight than gripping device 10.

Figure 13:
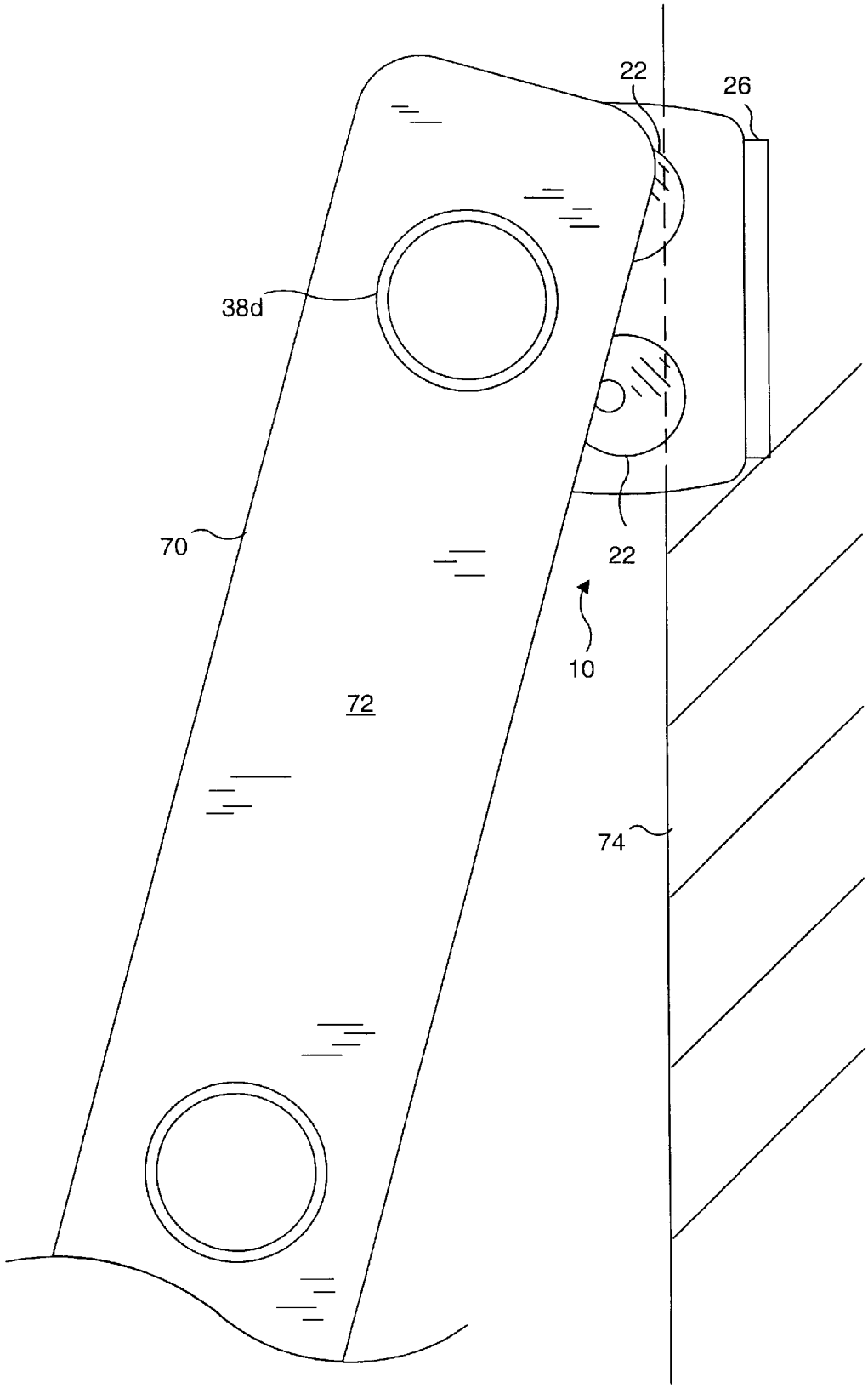
FIG. 13 is a side elevational view showing the first embodiment in use on a top rung of a ladder for supporting the ladder against a pole.
Figure 14:
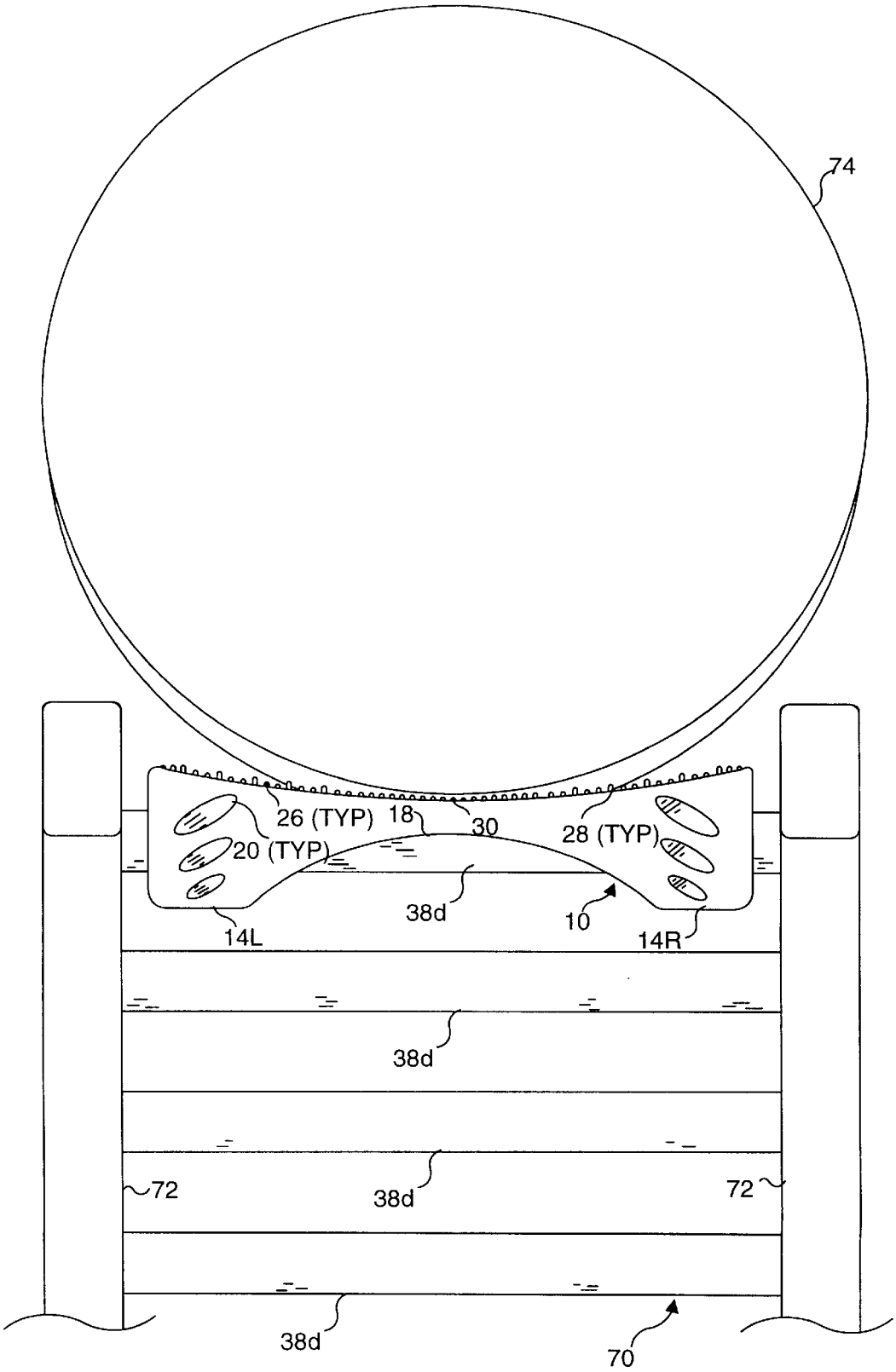
FIG. 14 is a top plan view showing of embodiment, ladder, and pole of FIG. 13.

In FIGS. 13 and 14, gripping device 10 is illustrated in use on a ladder rung 38*d* of a ladder 72 for supporting the ladder when leaned against a generally cylindrical object 74. It will be noted in FIG. 14, that stiles 72 of ladder 70 do not contact the cylindrical object. Instead, the ladder is fully supported against cylindrical object 74 by gripping device 10 and the texture of rear surface 30 prevents ladder 70 from slipping sideways and reduces the likelihood of rotation of the ladder around the cylindrical object.

Although the present invention has been described in connection with the preferred forms of practicing it and modifications thereto, those of ordinary skill in the art will understand that many other modifications can be made to the present invention within the scope of the claims that follow. Accordingly, it is not intended that the scope of the invention in any way be limited by the above description, but instead be determined entirely by reference to the claims that follow.

The invention in which an exclusive right is claimed is defined by the following:

1. A gripping device attachable to a ladder rung to stabilize a ladder relative to a surface of a structure that supports an upper portion of a ladder, comprising:

(a) a generally elongate elastomeric member;

(b) at least one slot formed in a front portion of the elastomeric member and extending longitudinally along the elongate elastomeric member, said at least one slot having an inner surface with a generally D-shaped cross section that is adapted to engage a rung of a ladder with which the gripping device is adapted to be used, an opening in said at least one slot being disposed in a curved portion of said generally D-shaped cross section and a flat portion of said generally D-shaped cross section is disposed adjacent and substantially parallel to a top side of said elongate elastomeric member, at least a portion of said slot providing a biasing force that aids in securing said gripping device to a rung of a ladder, said biasing force being provided by an elastomeric property of said generally elongate elastomeric member; and (c) a textured surface formed on a back of the elongate elastomeric member, said textured surface being adapted to provide a frictional force against a substantially vertical surface of a structure that supports an upper portion of a ladder, the frictional force stabilizing a ladder by preventing an upper portion of a ladder from moving relative said surface of the supporting structure.

2. The gripping device of claim 1, wherein the generally elongate elastomeric member is fabricated as an integral, single unit.

3. The gripping device of claim 1, wherein the generally elongate elastomeric member is fabricated from one of a plastic, a rubber, and a synthetic rubber material.

4. The gripping device of claim 1, wherein an inner surface of said at least one slot includes a plurality of texture elements that increase a coefficient of friction between the generally elongate elastomeric member and a ladder rung on which the gripping device is adapted to be attached, by inserting a ladder rung into said at least one slot.

5. The gripping device of claim 4, wherein the plurality of texture elements comprise at least one of a plurality of ribs and a plurality of spikes.

6. The gripping device of claim 1, wherein said at least one slot comprises a first slot disposed adjacent to one end of the elongate elastomeric member that is adapted to grip a rung adjacent to a first stile of a ladder, and a second slot disposed adjacent to an opposite end of the elongate elastomeric member that is adapted to grip a rung adjacent to a second stile of a ladder.

7. The gripping device of claim 1, wherein a mass of the generally elongate elastomeric member is reduced by removing a portion of the generally elongate elastomeric member.

8. The gripping device of claim 1, wherein the textured surface comprises a plurality of texture elements adapted to increase a coefficient of friction between the generally elongate elastomeric member and a surface of a structure that supports an upper portion of a ladder.

9. The gripping device of claim 8, wherein the plurality of texture elements comprise at least one of a plurality of spikes, a plurality of bristles, and a plurality of ribs.

10. The gripping device of claim 1, wherein the back of the elongate elastomeric member is concave, adapting the gripping device to be used for supporting a ladder against a structure that is generally cylindrical.

11. The gripping device of claim 1, wherein a mass of the generally elongate elastomeric member is reduced by including at least one cavity within an interior of the elongate elastomeric member.

12. The gripping device of claim 1, wherein a mass of the elongate elastomeric member is reduced by including at least one depression in a surface of the elongate elastomeric member.

13. The gripping device of claim 11, wherein said at least one cavity comprises an orifice that extends longitudinally through the generally elongate elastomeric member.

14. The gripping device of claim 1, further comprising an upper tang and a lower tang formed on opposite sides of said at least one slot, said upper tang and said lower tang being adapted to grip a rung of a ladder from opposite sides with the biasing force provided by the elastomeric material.

15. The gripping device of claim 2, further comprising:

(a) a first flexible strap having a plurality of orifices formed therethrough and extending from one side of said at least one slot; and (b) a knob disposed on a second flexible strap extending from an opposite side of said at least one slot and having a size and shape appropriate to fit through any of the plurality of orifices in an interference fit to attach said first strap to said second strap and being thereby adapted to attach the elongate elastomeric member to the rung of the ladder by closing around the rung after the rung is disposed with said at least one slot.

16. A stabilizing accessory for a ladder having a pair of stiles and a plurality of rungs extending between a pair of stiles, said stabilizing accessory comprising:

(a) a generally elongate body having a front side, a back side, a top side, a bottom side, and a length that is adapted to fit between a pair of stiles when aligned with a rung adjacent to a top portion of a ladder;

(b) at least one slot formed within the front side of the generally elongate body, said at least one slot having:

(i) an inner surface having a generally D-shaped cross section, such that a flat portion of said generally D-shaped cross section is disposed adjacent and substantially to the top side of said elongate body, and an opening in said inner surface is disposed through a curved portion of said generally D-shaped cross section at the front of said elongate body; and (ii) an upper gripping tang and a lower gripping tang above and below said opening, respectively, said tangs cooperating by applying a biasing force adapted to grip a rung on a ladder and thus secure the stabilizing accessory thereto, said upper gripping tang and said lower gripping tang comprising an elastomeric material that provides said biasing force; and (c) said back side of the stabilizing accessory having a textured surface that is adapted to prevent a ladder from shifting relative to a substantially vertical surface of a structure supporting a ladder.

17. The stabilizing accessory of claim 16, wherein the generally elongate body, the upper gripping tang, and the lower gripping tang are fabricated as a single unit from an elastomeric material.

18. The stabilizing accessory of claim 16, wherein the elastomeric material comprises one of a plastic and a synthetic rubber.

19. The stabilizing accessory of claim 16, wherein one of the upper gripping tang and the lower gripping tang comprises a first flexible strap having a plurality of orifices formed therein, and the other of the upper gripping tang and the lower gripping tang comprises a second flexible strap having a knob of a size and shape to form an interference fit when forced through any of the plurality of orifices in the first flexible strap, said first and second flexible straps being thereby adapted to fasten around said one of the plurality of rungs on the ladder to secure the stabilizing accessory thereto.

20. The stabilizing accessory of claim 16, wherein said at least one slot comprises a first slot disposed at one end of the elongate member that is adapted to be mounted to a rung adjacent a first stile of a ladder, and a second slot disposed at the other end of the elongate member that is adapted to be mounted to a rung adjacent to a second stile of a ladder.

21. The stabilizing accessory of claim 16, wherein a mass of the generally elongate member is reduced by including at least one of a depression and an orifice therein.

22. The stabilizing accessory of claim 14, wherein a mass of the generally elongate member is reduced by fabricating the generally elongate member with at least one cavity.

23. The stabilizing accessory of claim 22, wherein the at least one cavity comprises a longitudinal cavity.

24. The stabilizing accessory of claim 22, wherein the at least one cavity comprises a plurality of depressions formed into at least one of the top side and bottom side of the generally elongate member.

25. The stabilizing accessory of claim 16, wherein the back side comprises a plurality of texture elements to increase a coefficient of friction between that back side and a surface supporting an upper portion of a ladder.

26. The stabilizing accessory of claim 16, wherein the textured surface includes at least one of a plurality of bristles, a plurality of spikes, and a plurality of ribs.

27. The stabilizing accessory of claim 16, wherein the back side is concave and is thereby adapted to lean against a generally cylindrical surface.

28. The stabilizing accessory of claim 16, wherein an interior surface of said at least one slot includes a plurality of texture elements to increase a coefficient of friction between a rung of a ladder and the interior surface.

* * * * *